US005192488A

United States Patent [19]

Kawasaki

[11] Patent Number: 5,192,488

[45] Date of Patent: Mar. 9, 1993

[54] APPARATUS FOR HEATING MOLTEN IN A LADLE

[75] Inventor: Michio Kawasaki, Kanagawa, Japan

[73] Assignee: Fuji Electric Co., Ltd., Kawasaki, Japan

[21] Appl. No.: 782,483

[22] Filed: Oct. 25, 1991

Related U.S. Application Data

[62] Division of Ser. No. 610,249, Nov. 8, 1990.

[30] Foreign Application Priority Data

Nov. 9, 1989 [JP] Japan ..... 1-291533
Aug. 1, 1990 [JP] Japan ..... 2-204631

[51] Int. Cl.[5] ..... B22D 18/00
[52] U.S. Cl. ..... 266/208; 266/242
[58] Field of Search ..... 266/242, 208, 275; 373/155, 85

[56] References Cited

U.S. PATENT DOCUMENTS 3,677,332 7/1972 Smiernow ..... 266/242
4,336,411 6/1982 Hanas et al. ..... 373/85
4,618,964 10/1986 Larsson et al. ..... 373/155
4,735,256 4/1988 Kollberg et al. ..... 164/507

FOREIGN PATENT DOCUMENTS 0053070 6/1982 European Pat. Off. .
0119853 9/1984 European Pat. Off. .
2100095 2/1972 France .
61-137521 6/1986 Japan .

*Primary Examiner*—Scott Kastler
*Attorney, Agent, or Firm*—Finnegan, Henderson, Farabow, Garrett and Dunner

[57] ABSTRACT

An apparatus for heating molten metal including a ladle provided with a refractory heat insulating material and first core members arranged in pairs and attached to the outer circumference of the ladle. A tray capable of mounting said ladle carries second cores with magnetic pole portions at both ends of said cores as to face the ladle mounted first cores. A coil is provided for exciting the second cores. The first cores and magnetic pole portions of second cores are located at the outer circumferential portion of the ladle to face each other radially in a manner to facilitate placement and removal of the ladle to and from the tray. Position sensors are provided to ensure positional accuracy of the first ladle carried cores and the poles of the second cores. The coils are physically and thermally protected from ladle heat by appropriate shock absorbing and thermal insulating provisions. Thermal protection of the cores can be further enhanced by cooling embodiments. The ladle, or the ladle and tray, may be enclosed in a vacuum chamber.

4 Claims, 6 Drawing Sheets

FIG. 8
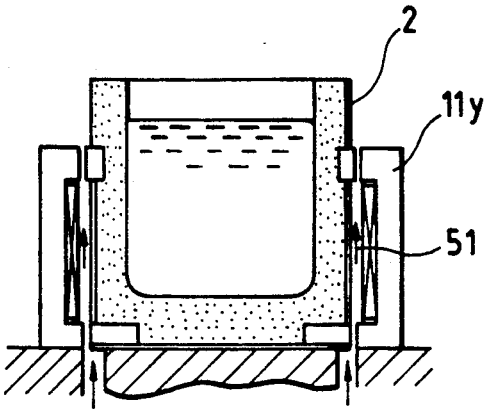
FIG. 9
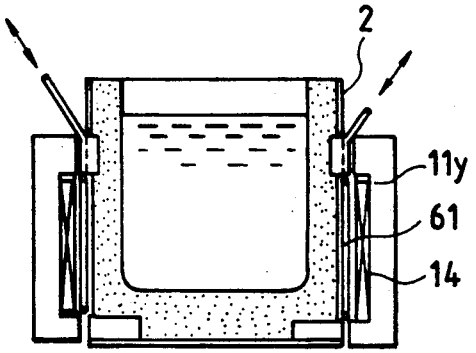
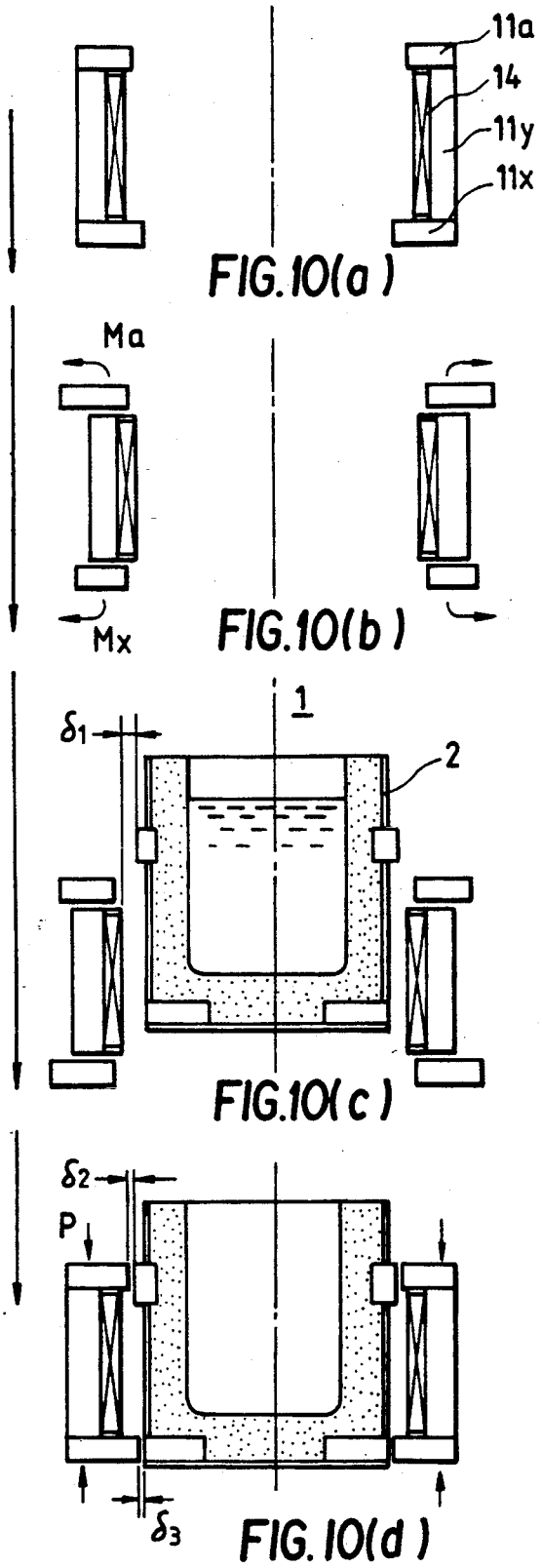

FIG. 11
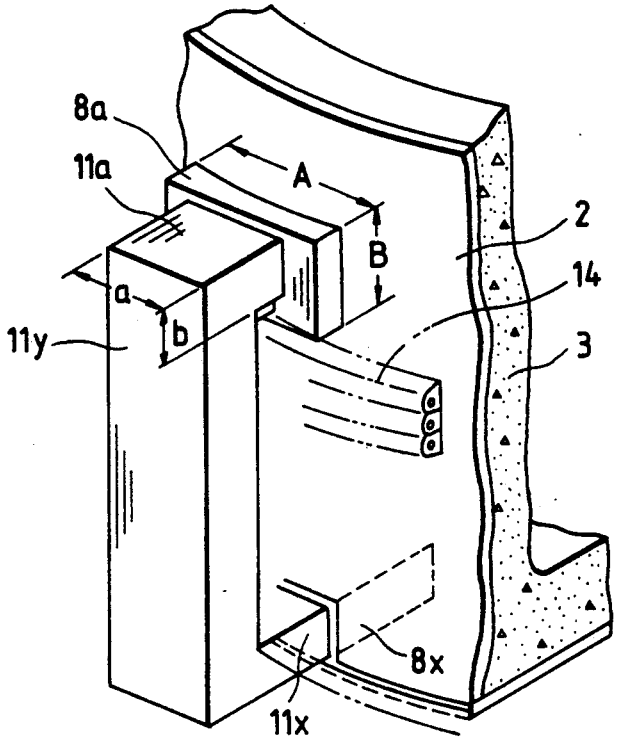
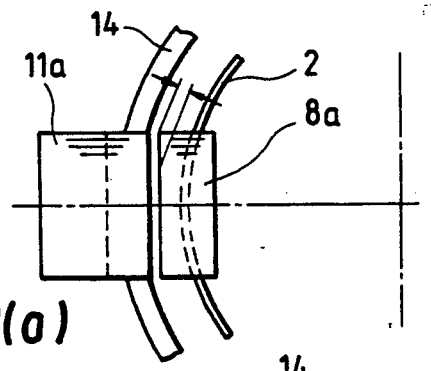
FIG.12(a)
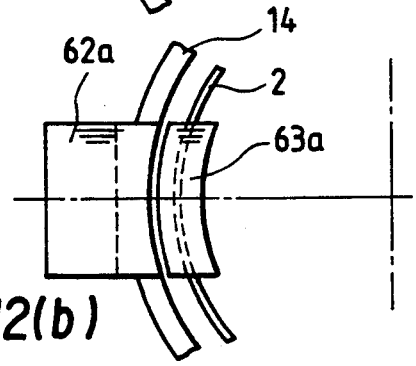
FIG.12(b)
FIG. 13
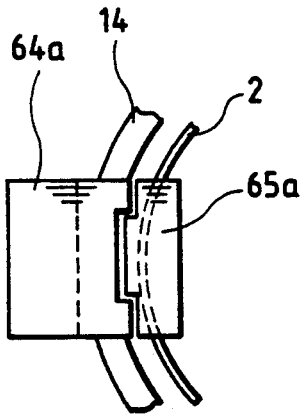

APPARATUS FOR HEATING MOLTEN IN A LADLE

This is a division of application Ser. No. 07/610,249, filed Nov. 8, 1990.

BACKGROUND OF THE INVENTION

1. Field of the Invention

The present invention relates to an apparatus for heating in a ladle molten metal, to be poured into a mold.

2. Discussion of the Related Art

In the case where the temperature of molten metal in a ladle to be poured into a mold falls so that the fluidity of the molten metal becomes less fluid than is required for proper molding procedures, the molten metal in the ladle may be returned to a melting furnace to be remelted. However, the remelting of cooled or solidified metal is undesirable because of considerable energy losses incurred.

Therefore, an induction heating apparatus has been developed for a ladle in which first cores are attached to a ladle adapted to be mounted on a supporting tray, to which second cores and a coil are fixed, to maintain the molten metal in the ladle in a fluid state at all times. Such an apparatus is conventional and disclosed in Japanese Patent Unexamined Publication No. Sho-61-137521.

FIG. 17 of the accompanying drawings is a sectional view of the conventional apparatus. A ladle 1 includes metal shell body 2 made for a non-magnetic material such as stainless steel, and a refractory heat-insulating material 3 spread on the inside of the metal shell 2. Hanging rods 5, 5 are linked to trunnion shafts 4, 4 projecting from opposite sides of the metal shell 2. A driven wheel 6 for inclining the ladle is mounted to one trunnion shaft 4 First cores 8*a* and 8*b*, arranged in pairs circumferentially at intervals of a predetermined pitch are attached to the outer circumferential portion 3*a* and the outer bottom portion 3*b* of the refractory heat-insulating material 3. Second cores 11, corresponding in number and pitch to the first cores 8*a* and 8*b*, are fixed on a tray 10 which is fixed on a floor 9 for mounting the ladle 1 from above. A supporting member 12 for engaging the bottom portion of the ladle 1 and a stopper 13 for positioning the ladle 1 circumferentially are provided in the tray 10 so that the first cores 8*a* and 8*b* in each pair can be aligned with and face magnetic pole portions 11*a* and 11*b* provided at the opposite ends of corresponding one of the second cores 11 when the ladle 1 is put on the tray 10. Further, a coil 14 is wound on the second cores 11.

When the coil 14 is energized to excite the second cores 11, an alternating magnetic field 16 is produced in molten metal 15 in the ladle 1 through the first cores 8*a* and 8*b* to effect induction heating of the molten metal 15 to maintain the molten metal 15 in a suitably fluid state.

In the aforementioned conventional apparatus, the second cores 11 and the coil 14 for producing heating energy, together with power cables and water-cooled pipings (not shown), are fixed to the tray 10 side. Accordingly, the conventional apparatus has an advantage in that the structure for providing the tray related members can be simplified and the ladle 1 containing the molten metal 15 can be moved freely by hanging rods 5 or can be inclined by trunnion shafts 4.

However, the L-shaped configuration of the second cores 11 makes it difficult to produce the second cores 11. If the height of the magnetic pole portion 11*b* of each second core 11 and the height of the stopper 13 cannot be established accurately, the magnetic pole portion 11*b* may collide with some corresponding first core 8*b* in the bottom portion 3*b* of the ladle 1, causing breakage or the gap between the magnetic pole portion 11*b* and the first core 8*b* to be unacceptably large. This latter condition results in an increase of reluctance, increase of energy loss and abnormal heating of the ladle periphery.

SUMMARY OF THE INVENTION

The present invention has been made in view of the above circumstances and has as an object to provide an apparatus for heating molten metal in a ladle having ladle mounted first cores co-operable with second cores and coil means mounted on a supporting tray adapted to receive the ladle and by which positional relationship of pole portions at the ends of the respective cores assures highly efficient induction heating of the ladle contents.

Another object of the present invention is the provision of such an apparatus in which the configuration of the cores enables low cost manufacture thereof.

A further object of the present invention is to provide an apparatus of the type referred to which facilitates placement and removal of the ladle on and from the supporting tray without damage to the cores or the poles thereof.

A still further object of the invention is the provision of such an apparatus by which magnetic flux leakage into and resulting in overheating of isolated portions of the ladle are minimized.

Another object of the invention is to provide such an apparatus by which the coils are protected from shock by contact of the ladle as it is positioned on the tray.

Still another object of the present invention is the provision of an apparatus of the type referred to which enables complete adjustment of core/pole positional relationship as the ladle is placed on the tray either during or after such placement.

Yet another object of the invention is to provide such an apparatus which enables the use of, as well as the provision of, diverse pole configurations for the respective cores and by which heating efficiency under varying conditions of use may be optimized.

Another object of the invention is the provision of apparatus of the type described in which the coil is protected from ladle heat.

A still further object of the invention is to provide an apparatus of the type mentioned which facilities containment of the ladle and tray or the ladle by itself in a vacuum chamber.

Addition objects and advantages of the invention will be set forth in part in the description which follows and in part will be obvious form the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the apparatus of this invention comprises an apparatus for heating molten metal comprising, a ladle for holding the molten metal and provided with a refractory heat-insulating material, first cores arranged in pairs and attached to the outside of the refractory heat-insulating material of the ladle, a tray capable of mounting the ladle, second cores attached to the tray and having magnetic pole portions at both ends of the respective second cores so as to face the first cores, and a coil for exciting the second cores, wherein the magnetic pole portions and the pairs of first cores are arranged to face each other radially at the outer circumferential portions of the ladle.

The invention is further embodied in alternative forms of sensing and positioning mechanisms so that when the ladle is mounted in the tray, alignment and proximity of poles on the second cores paired with the first cores are ensured. Additionally, exemplary embodiments of the invention may include a provision for insulating the coil on the second core both physically and thermally through the provision of circumferential spaced axial shock bars of non magnetic metal, such as stainless steel, and filling the space between the shock bars with thermal insulating material. Alternatively, the thermal insulation of the coils on the second core from the hot ladle may be achieved by either gaseous or liquid cooling system.

While the radial facing arrangement of the magnetic pole portions with the pairs of first cores at the outer circumferential portions of the ladle facilitates placement of the ladle in the tray containing the second cores and coil, an enhancement of this feature is accomplished by an embodiment having movable magnetic pole portions on the second cores. In this embodiment, the magnetic pole portions may be pivoted or otherwise moved radially away from the ladle as it is being placed on the tray and then returned to an operative inductive heating position with respect to the second cores, under pressure, when the ladle is fully in place. Either one or the other or both of the first core and magnetic pole configurations may be modified to enhance the inductive efficiency of the heating system. The invention further includes an embodiment with variations for encapsulating the ladle in a vacuum container.

BRIEF DESCRIPTION OF THE DRAWINGS

The accompanying drawings, which are incorporated in and constitute a part of this specification illustrate embodiments of the invention and, together with the description, serve to explain the objects, advantages and principles of the invention. In the drawings.

FIGS. 2(*c*) and 2(*d*) are radial cross sectional views showing relative positions of the ladle and the second cores of FIG. 1;

FIG. 8 is a sectional view showing a cooling system for use in the embodiment of FIG. 1;

FIG. 9 is a sectional view showing an alternative embodiment of the cooling system shown in FIG. 8;

FIGS. 10(*a*) to 10(*d*) are sectional views showing an alternative embodiment of the second core structure shown in FIG. 1 and sequential positional mode during use;

FIG. 11 is a fragmentary perspective view of an alternative embodiment of the first core of FIG. 1;

FIGS. 12*a* and 12*b* are fragmentary sectional views showing alternative forms of the pole/core configurations usable in the embodiment of FIG. 1;

FIG. 13 is a similar sectional view of a still further variant in pole/core configuration;

DETAILED DESCRIPTION OF THE PREFERRED EMBODIMENTS

Reference will now be made in detail to the present exemplary embodiments of the invention, examples of which are illustrated in the accompanying drawings. Wherever possible, the same reference numbers will be used throughout the drawings to refer to the same or like parts.

Figure 1:
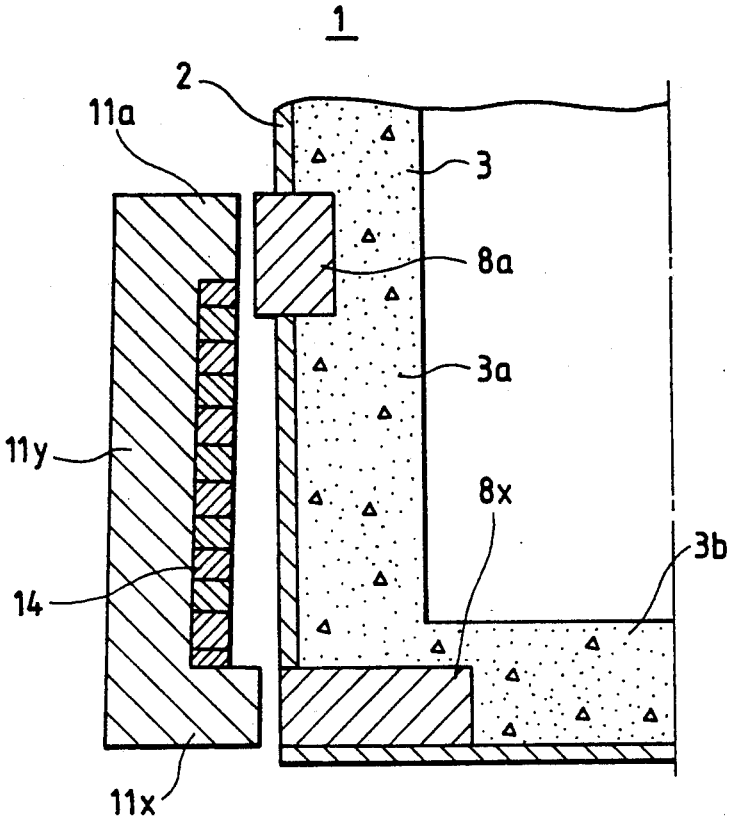
FIG. 1 is a fragmentary cross section illustrating a first embodiment of the present invention.
Figure 17:
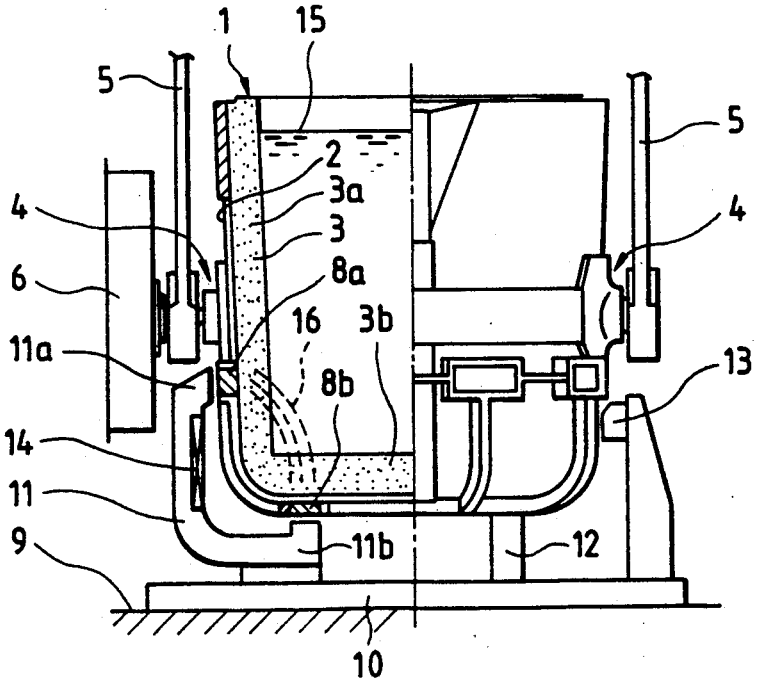
FIG. 17 is a sectional view of the conventional apparatus.
Figure 2A:
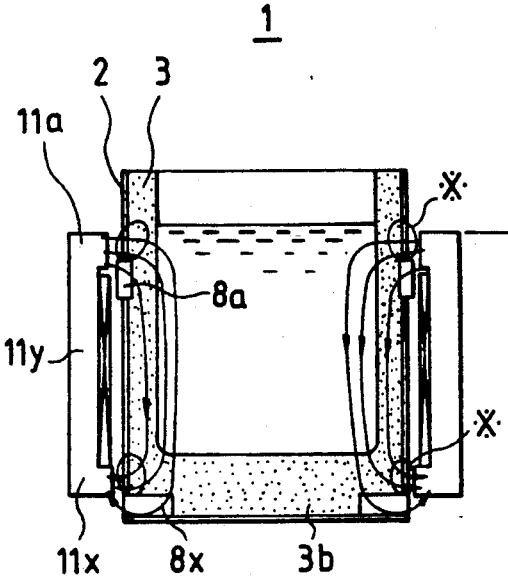
FIGS. 2(*a*) and 2(*b*) are axial cross sections showing relative positions of the ladle and the second cores depicted in FIG. 1.
Figure 2B:
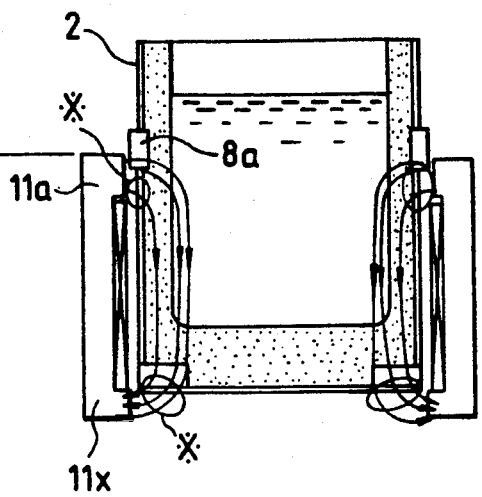
Figure 2C:
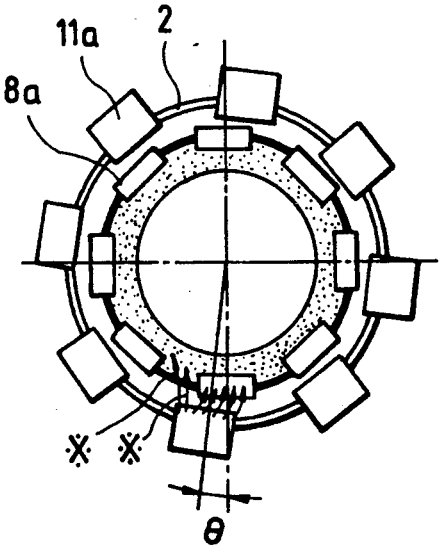
Figure 2D:
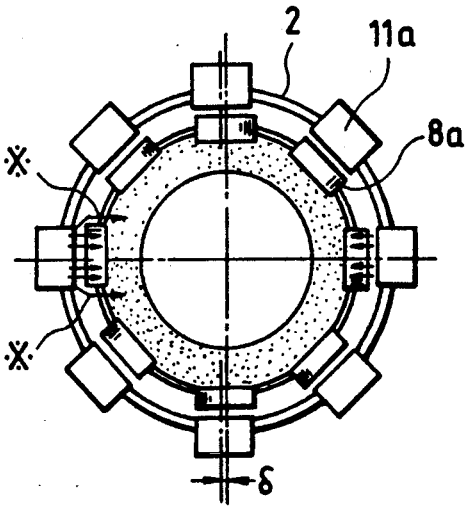

In FIG. 1, the ladle 1 is composed of a metal shell 2 and a refractory heat-insulating material 3. The refractory heat-insulating material 3 has a bottom portion 3*b* and a cylinder portion 3*a*. The ladle 1 is moved and inclined by trunnion shafts and hanging rods for supporting them in a manner described previously with respect to FIG. 17. Poles 8*a* and 8*x* in each pair of first cores attached to the ladle 1 are oriented to face radially in the cylinder portion 3*a*. A second core 11*y*, having magnetic pole portions 11*a* and 11*x* radially facing the poles 8*a* and 8*b*, respectively, is substantially of elongated C-shaped configuration. The second core 11*y* is provided with a heating coil 14 and is fixed onto a tray (not shown). The trunnion shafts, the hanging rods, and the tray (not shown) are arranged in the same manner as in the conventional apparatus.

In the aforementioned structure, the poles 8*a* and 8*x* in each pair of the first cores are attached in the cylinder portion 3*a* of the ladle 1. Accordingly, the poles 8*a* and 8*x* in each pair of the first cores are arranged to face the second core 11*y* through a radial gap, and when the ladle 1 is lowered to be placed on the tray, they present no obstruction to the relative positioning in the vertical or axial direction. Accordingly, not only is collision of the magnetic pole portions 11*a* and 11*x* prevented, but also excessive enlargement of the gap is prevented. Because of the elongated C-shaped configuration of the second core 11*y*, the magnetic pole portions 11*a* and 11*b* project slightly radially at opposite ends. In short, the shape of the second core is simplified to avoid the wasteful L-shaped magnetic circuit of the prior art. The metal shell 2 may be circumferentially jointed through one or more insulating plates to thereby prevent heating caused by a current induced circumferentially.

The first cores may be arranged in pairs vertically and the coil may be arranged so as to be wound on the ladle. Alternatively, the first cores may be arranged in pairs circumferentially and the coil may be arranged so as to be wound on the second cores.

The relative positional relationship between the first and second cores in the apparatus of FIG. 1 is shown in FIGS. 2(*a*) through 2(*d*). In FIG. 2(*a*), the first cores 8*a* and 8*x* have a downward bias with respect to the second core 11*y*. In FIG. 2(*b*), the first cores 8*a* and 8*x* have an upward bias with respect to the second core 11*y*. Consequently, magnetic flux leaks into the portions or the metal shell 2 designated by the mark X to overheat those portions. In FIG. 2(*c*), the first cores 8*a* and 8*x* are circumferentially inclined by ¼, so that the same phenomenon occurs in the portions designated by the mark X in the circumferential direction. In FIG. 2(*d*), the first cores 8*a* and 8*x* are eccentrically moved by δ, so that reluctance in the larger gap side increases. Consequently, the larger gap side is overheated because of the leakage into the metal shell 2. On the contrary, the smaller gap side may be broken because of mechanical contact. To solve the aforementioned problems, several embodiments shall be described below.

Figure 3:
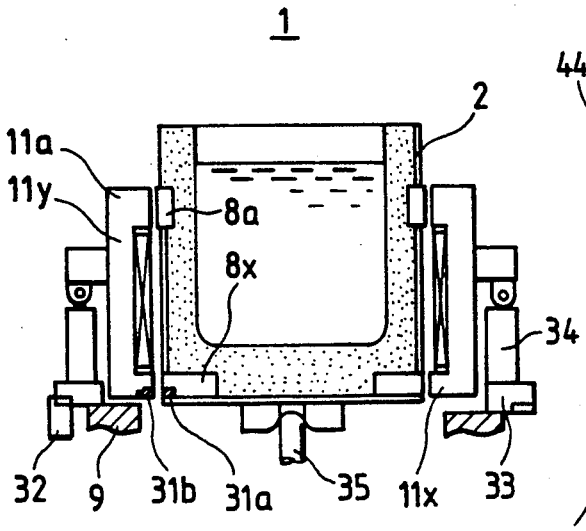
FIG. 3 is a sectional view showing an embodiment of a sensing and positioning mechanism of the present invention.

In the embodiment shown in FIG. 3, a pair of position sensors 31*a* and 31*b* are provided in the ladle-side first core 8*x* and the tray-side magnetic pole portion 11*x* respectively. As may be seen from FIG. 3, movement in the circumferential direction as well as movement in the vertical direction can be detected. If pairs of position sensors are provided circumferentially, movement in the radial directions can be detected. If position sensors are provided in the upper portion of the ladle, movement in the axial direction can be detected. Although the embodiment shows the case where the position sensors are provided in the core and the magnetic pole position, the invention is not limited to this specific embodiment.

Further, each of the second cores 11 is mounted on a second core base 33 rotatable on the floor 9 through a gear 32 so that the second core is vertically movable by a cylinder 34. The center position and the vertical position of the bottom portion 3*b* of the ladle 1 with respect to the floor 9 are adjusted by the pivoting mechanism 35.

Figure 4:
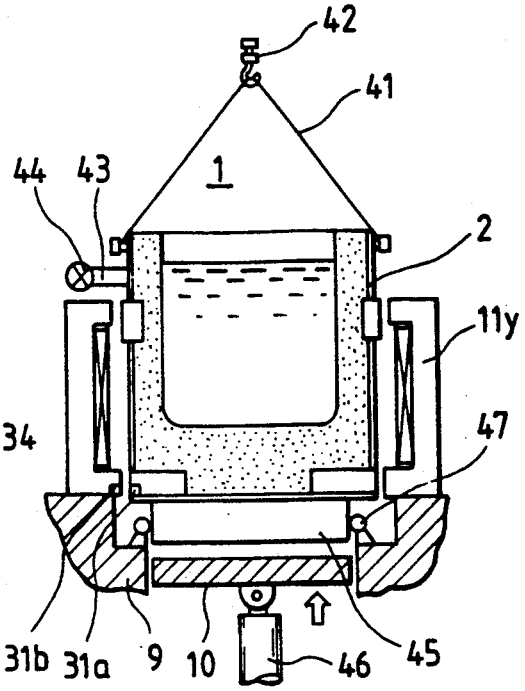
FIG. 4 is a sectional view showing a alternative embodiment of the mechanism shown in FIG. 3.

In FIG. 4, the position of the ladle 1 hung by a hanging wire 41 and a hook 42 is adjusted. An arm 43 provided in the upper portion of the ladle 1 is turned by an actuator 44 from the second core 11*y* side. Side rollers 47 in the floor 9 are brought into contact with the outer circumference of an annular member 45 fixed to the bottom portion 3*b* to thereby automatically adjust the center position thereof. The vertical position of the ladle is adjusted by a cylinder 46 operable to move the tray 10 vertically. The annulae member 45 may be replaced by a disk. The annular member 45 may be brought into contact with the rollers at the circumference thereof.

Figure 5:
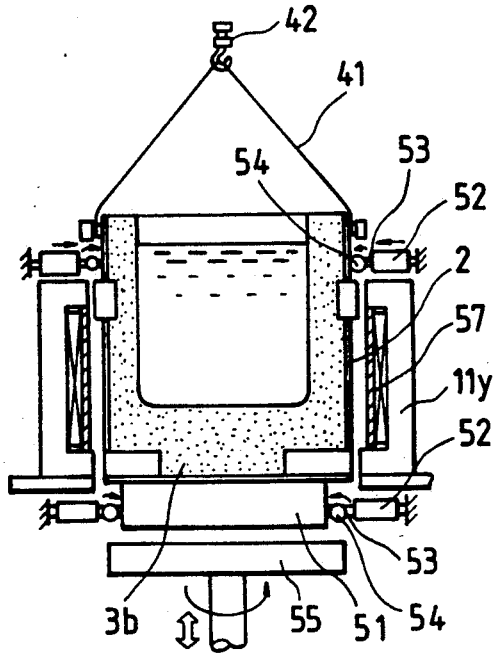
FIG. 5 is a sectional view showing a further alternative embodiment of the ladle positioning mechanism of this invention.
Figure 6:
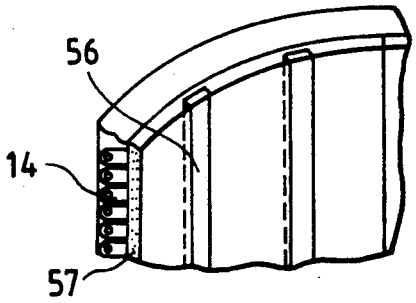
FIG. 6 is a fragmentary perspective view of a part in the embodiment of FIG. 5.
Figure 7:
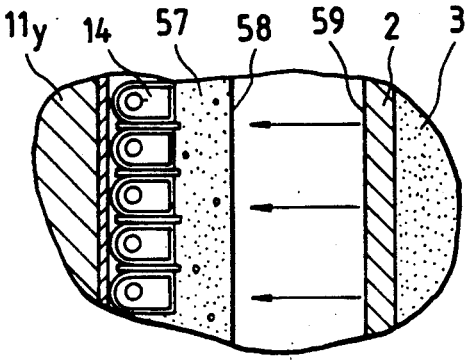
FIG. 7 is an enlarged sectional view of a part shown in FIG. 6.

In the embodiment shown in FIGS. 5, 6 and 7, push-rods 53 radially moved by cylinders 52 are provided at the outer circumference of a disk 51 fixed to the bottom portion 3*b* of the ladle 1. Further, rollers 54 are attached to ends of the push-rods 53, respectively to ensure a smooth, low friction engagement of the disk 51. Similar cylinders 52, push-rods 53 and rollers 54 for adjusting the radial position are provided in the outer circumference of the metal shell 2 in the upper portion of the ladle 1. The circumferential position of the disk 51 is adjusted by the rotation of a table 55.

In this embodiment, circumferentially spaced, axial, rail-like members 56 of shock protection material, such as non-magnetic stainless steel and a heat-insulating material 57 are provided in the inner circumference of the coil 14.

Further, in this embodiment, means for cooling the ladle 1 is provided. A black surface layer 58 for receiving heat radiation from the metal shell 2 may be provide in the inner circumference of the coil 14. On the other hand, a black rough surface layer 59 for increasing heat radiation from the ladle side may be provided on the metal shell 2.

In the embodiment shown in FIG. 8, a cooling gas 51 is provided between the coil 14 and the metal shell 51. In a related embodiment shown in FIG. 9, a water-cooled radiator pipe 61 is provided to pass cooling water into the inner surface of the coil 14.

In a further embodiment of the invention shown in FIGS. 10(*a*) through 10(*d*), magnetic pole portions 11*a* and 11*x* can be moved both axially and radially, with respect to the second core 11*y* having the coil 14, by a magnetic pole moving means such as an actuator (not shown). When the ladle 1 in the state shown in FIG. 10(*a*) is to be inserted, the magnetic pole portions 11*a* and 11*x* are moved in the directions of the arrows Ma and Mx in FIG. 10(*b*). Because the magnetic pole portions 11*a* and 11*x* project inward with respect to the coil 14, the distance $R_1$ between the inner circumference of the coil 14 and the first core becomes sufficiently large (as shown in FIG. 10(*c*)) when the ladle is inserted, that contact between the ladle carried parts and the core related parts is avoided. Accordingly, damage to the magnetic pole portions is avoided during the insertion. After the ladle 1 is inserted, the magnetic pole portions 11*a* and 11*x* are moved in directions reverse to the directions of the arrow Ma and Mx shown in FIG. 10(*d*) to be returned to its original position. At this time, the contacting pressure between the second core 11*y* and the magnetic pole portions 11*a* and 11*x* is increased sufficiently by applying force P thereto to prevent both the increase of reluctance and the occurrence of electromagnetic vibration. If the magnetic pole portions 11*a* and 11*x* are brought into direct contact with the first cores 8*a* and 8*x* to make $8_1$ and $8_2$ zero, total reluctance can be reduced further. Although this embodiment shows the case where each of the motions Ma and Mx is formed by a combination of vertical motion and outward motion, the invention can be applied to the case where pivotal motion about a fulcrum (not shown) at the external diameter side of the magnetic pole portion may be used.

In FIG. 11, the first core 8*a* in the metal shell of the ladle 1 is larger, both in the axial direction and in the tangential direction, than the magnetic pole portion 11*a* facing the first core 8*a*. In the case where the two are in correct relative positions, the leakage of magnetic flux into the metal shell 2 is reduced to prevent the overheating of the metal shell. The same effect can be attained even in the case where the relative positions of the poles are substantially out of alignment. It is preferable that each of the ratio of A to a and the ratio of B to b is from about 1.3 to about 2. The size of the lower first core 8*x* can be determined in the same manner as described above.

In FIGS. 12*a* and 12*b*, two pole/core shapes are shown. Where the gap between the magnetic pole portion 62*a* and the first core 63*a* is arranged to coincide with a circular are having its center at the axis of the ladle, (FIG. 12*b*) the following advantages arise compared with the case where the gap between the magnetic pole portion 11*a* and the first core 8*a* is arranged in the tangential direction (FIG. 12*a*). The distance between the coil 14 and the metal shell 2 can be reduced, so that induction heating efficiency can be improved. Accordingly, not only the size of the apparatus can be reduced but also collision caused by the circumferential movement of the relative positions can be prevented.

FIG. 13 shows a modification of the pole/core configuration of FIGS. 12*a* and 12*b*. In FIG. 13, the gap is shaped like an approximate arc having steps. Accordingly, the kind of iron core snap flask for producing the magnetic pole portion 64*a* and the first core 65*a* can be reduced so that efficiency can be improved.

Figure 14:
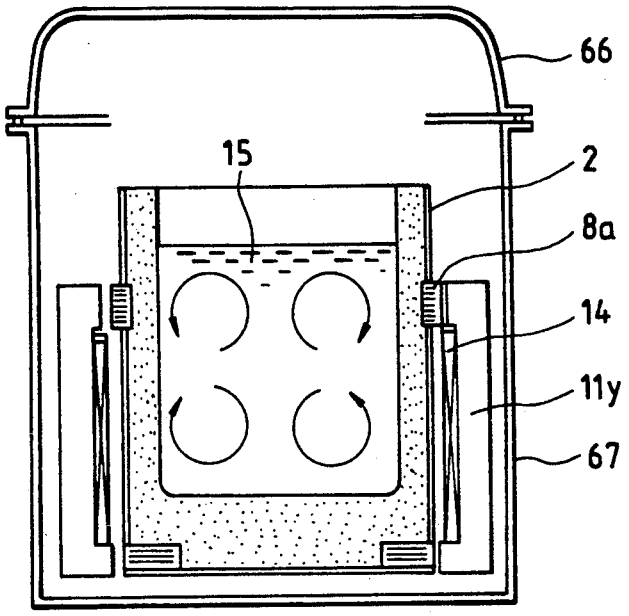
FIG. 14 is a sectional view of one embodiment of a vacuum container for the apparatus of the invention.
Figure 15:
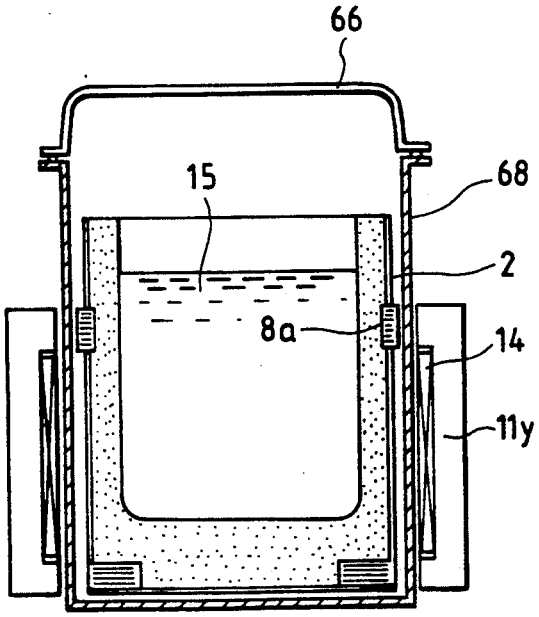
FIG. 15 is a sectional view of an alternative vacuum container embodiment.
Figure 16:
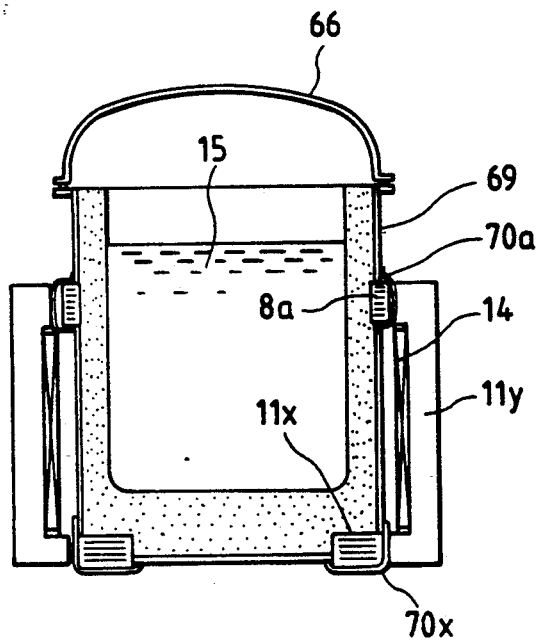
FIG. 16 is a sectional view of a further alternative embodiment of a vacuum container.

FIGS. 14 through 16 show embodiments in which the ladle is placed in a vacuum container and subjected to a metallurgical treatment such as a vacuum degas treatment. In FIG. 14, not only the ladle 1 is contained in a vacuum container 67 having a cover 66 but also the second core 11*y* having the coil 14 is within the vacuum container 67. In FIG. 15, the second core fly having the coil is placed on the outside of a vacuum container 68, so that the coil in air is free from corona discharge produced in a vacuum. Accordingly, a high voltage can be utilized with no necessity of a large-size electric circuit.

In FIG. 16, the vacuum container 69 has a special shape and also serves as the metal shell of the ladle. Covers 70*a* and 70*x* are made of a non-magnetic material and provided to keep the first cores 8*a* and 8*x* in a vacuum the covers are formed, by welding or the like, over the first cores 8*a* and 8*x* piercing the vacuum container 69.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended thereto, and their equivalents.

What is claimed is:

1. An apparatus for heating molten metal comprising:

a ladle for holding said molten metal and provided with a refractory heat-insulating material having an outer circumference;

first cores arranged in pairs and attached to the outer circumference of said refractory heat-insulating material of said ladle;

a tray capable of mounting said ladle;

second cores attached to said tray and having magnetic pole portions at both ends of said respective second cores so as to face said first cores;

a coil for exciting said second cores; and a vacuum container having a cover capable of being opened and closed for receiving said ladle.

2. An apparatus for heating molten metal according to claim 1, wherein said second core and said coil are receivable in said vacuum container.

3. An apparatus for heating molten metal according to claim 1, wherein said second cores and said coil are located outside of said vacuum container.

4. An apparatus for heating molten metal according to claim 1, wherein said vacuum container is a metal shell constituting an outer layer of said ladle.

* * * * *

UNITED STATES PATENT AND TRADEMARK OFFICE

CERTIFICATE OF CORRECTION

PATENT NO. : 5,192,488

DATED : March 09, 1993

INVENTOR(S) : Michio KAWASAKI

It is certified that error appears in the above-indentified patent and that said Letters Patent is hereby corrected as shown below:

Abstract, line 6, after "cores", insert --so--.

On the title page: Item [54] and Column 1, line 1,
after "MOLTEN", insert --METAL--.

Signed and Sealed this

Twenty-second Day of March, 1994

Bruce Lehman

*Attest:*

BRUCE LEHMAN

*Attesting Officer*

*Commissioner of Patents and Trademarks*